US011414991B2

(12) United States Patent
Zhang et al.

(10) Patent No.: US 11,414,991 B2
(45) Date of Patent: Aug. 16, 2022

(54) SYSTEM AND METHOD FOR MONITORING BEARING COMPRESSION RATE OF FILLER IN COAL MINE GOB AREA

(71) Applicant: CHINA UNIVERSITY OF MINING AND TECHNOLOGY, Jiangsu (CN)

(72) Inventors: Jixiong Zhang, Jiangsu (CN); Yang Ju, Jiangsu (CN); A. J. S. (Sam) Spearing, Jiangsu (CN); Meng Li, Jiangsu (CN); Nan Zhou, Jiangsu (CN); Weiqing Zhang, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 27 days.

(21) Appl. No.: 17/253,126

(22) PCT Filed: Jun. 24, 2019

(86) PCT No.: PCT/CN2019/092465
§ 371 (c)(1),
(2) Date: Dec. 17, 2020

(87) PCT Pub. No.: WO2020/093703
PCT Pub. Date: May 14, 2020

(65) Prior Publication Data

US 2021/0277779 A1 Sep. 9, 2021

(30) Foreign Application Priority Data

Nov. 6, 2018 (CN) ..... 201811313339.1

(51) Int. Cl.
*E21F 15/00* (2006.01)
*E21F 17/18* (2006.01)
*E21F 15/02* (2006.01)

(52) U.S. Cl.
CPC ..... *E21F 17/185* (2013.01); *E21F 15/005* (2013.01); *E21F 15/02* (2013.01)

(58) Field of Classification Search
CPC ..... E21F 17/18; E21F 17/185; E21F 15/005; E21F 15/02
See application file for complete search history.

(56) References Cited

FOREIGN PATENT DOCUMENTS

CN 105181463 12/2015
CN 204945096 1/2016
(Continued)

OTHER PUBLICATIONS

"International Search Report (Form PCT/ISA/210) of PCT/CN2019/092465," dated Sep. 3, 2019, with English translation thereof, pp. 1-4.

*Primary Examiner* — Sunil Singh
(74) *Attorney, Agent, or Firm* — JCIP Global Inc.

(57) ABSTRACT

Provided are a system and a method for monitoring bearing compression rate of a filler in a coal mine gob area. An ground information processing system, a vibration source control system, and a monitoring system are arranged on the ground according to a buried depth of the filler in the gob area. The vibration source control system generates vibration, and transmits a signal to the filler. The monitoring system on the ground receives different reflected waves according to different elasticities of the fillers under different compaction degrees. Final data is transmitted to the ground information processing system for data processing. The monitoring of the filler starts when the filler is filled in the gob area; the filler is gradually compacted. The filler is monitored until the thickness of the filler does not change. Finally, a bearing compression rate formula is utilized to calculate the bearing compression rate of the filler.

5 Claims, 1 Drawing Sheet

(56) References Cited

FOREIGN PATENT DOCUMENTS

| | | | |
|---|---|---|---|
| CN | 109441541 | | 3/2019 |
| EP | 1516961 | A1 * | 3/2005 |
| EP | 3458088 | A2 * | 5/2012 |
| JP | H06167326 | | 6/1994 |
| WO | WO 86/04672 | A1 * | 8/1986 |

* cited by examiner

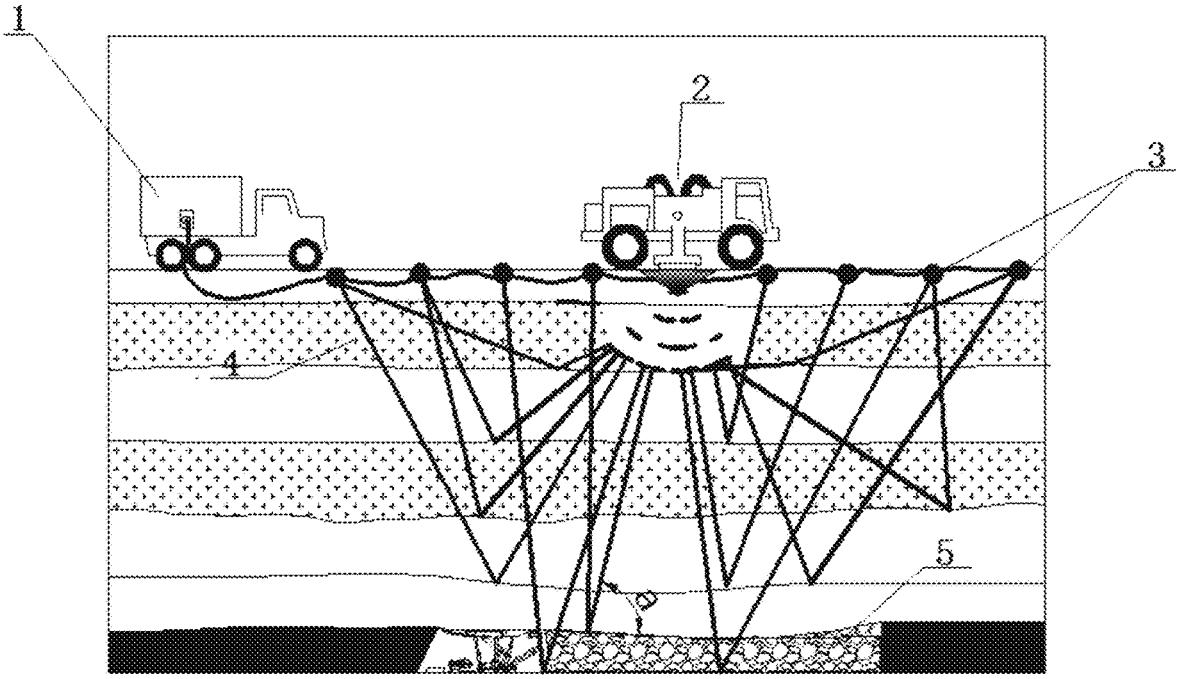
1
2
3
4
5

SYSTEM AND METHOD FOR MONITORING BEARING COMPRESSION RATE OF FILLER IN COAL MINE GOB AREA

CROSS-REFERENCE TO RELATED APPLICATION

This application is a 371 of international application of PCT application serial no. PCT/CN2019/092465, filed on Jun. 24, 2019, which claims the priority benefit of China application no. 201811313339.1, filed on Nov. 6, 2018. The entirety of each of the above mentioned patent applications is hereby incorporated by reference herein and made a part of this specification.

TECHNICAL FIELD

The present invention relates to the technical field of coal resource green filling and mining, and more particular to a system and method for monitoring bearing compression rate of a filler in a coal mine gob area.

BACKGROUND

At present, with the mining and utilization of coal resources, coal mining causes the environmental problems such as gangue stockpiling, ground surface subsidence and the like, and the surrounding people suffer from huge economic loss; China pays close attention to the influence of coal mining on the environment; therefore, a solid filling and mining technology, as a green mining technology, is widely used in some regions.

The main object during solid filling and mining is to prevent ground surface subsidence, and the other object is to effectively solve the problem of gangue stockpiling on the ground and fill the gangue in-situ without lifting the gangue out of a well. However, during filling and mining, the compression rate of a filler is determined by utilizing a "equivalent mining height" principle to introduce an equivalent mining height concept in the initial compaction process, that is, the equivalent mining height is the height after subtracting the height of the compacted filler in a gob area from the height of a working face. After filling, the movement of roof rock formation causes further compaction of the filler. Therefore, how to accurately monitor the bearing compression rate of the filler in a period of time after filling or even during filling is an important problem that green filling and mining of coal resources face. In order to effectively improve the filling efficiency and reduce the surface subsidence, it has a great significance to develop a method for monitoring the bearing compression ratio of a filler in a gob area and to explore how to effectively fill a gob area.

SUMMARY OF THE INVENTION

Object of the present invention: in order to overcome the defects in the prior art, the present invention provides a system and method for monitoring bearing compression rate of a filler in a coal mine gob area, solves the problem of the bearing compression rate of the filler during solid filling and mining, not only can monitoring the bearing compression rate of the filler, but also can improve the filling efficiency.

Technical solution: to achieve the above object, the technical solution adopted by the present invention is:

A system for monitoring bearing compression rate of a filler in a coal mine gob area, including a ground information processing system, a ground vibration source control system, and a ground monitoring system which are all disposed on the ground above the filler, wherein the ground information processing system is used to receive an electrical signal from the ground monitoring system, and processes the electrical signal, wherein the electrical signal is converted from a reflected wave signal of the filler by a wave detector of the ground monitoring system; the ground information processing system is further used to determine a depth that a signal transmitted by a controllable vibration source reaches according to wave energy consumption, and utilize a bearing compression rate formula to calculate the bearing compression rate of the filler according to a difference between a thickness of the compacted filler under a 2 MPa initial pressure and a thickness of the stabilized filler;

the ground vibration source control system is used to adjust a vibration amplitude of the vibration source on the ground according to a depth of a filler to be tested, and transmit a stereo signal in a direction from the center of an upper surface of the controllable vibration source to the filler in the gob area; and The ground monitoring system is a wave detector, and is used to receive reflected waves transmitted from different depths and different angles under the wave detector by the fillers with different compaction degrees, convert the reflected waves into electrical signals, and transmit the electrical signals to the ground information processing system.

Further, the effective depth of a coal seam that the wave detector monitors is 100-300 m, and the maximum effective thickness is 3.5 m.

Further, in the effective depth range of the entire coal seam, an angle $\alpha$ between the reflected wave and the horizontal plane is in the range 30°-90°.

Further, the wave detectors are arranged at positions on the ground corresponding to the fillers; the wave detectors are arranged in the trend of the coal seam, forming a ground monitoring point arrangement route which centers on the vibration source control system above a working face and extends to the two sides of the ground vibration source control system in the trend; the wave detectors are linearly uniformly distributed; and one wave detector is arranged every 20 m on the two sides.

Further, the ground vibration source control system transmits a vibration source signal to the filler in the underground gob area; the ground monitoring system receives different reflected wave signals according to different elasticities of the fillers under different compaction degrees, converts a transmitted wave signal into an electrical signal, and transmits the electrical signal to the ground information processing system, so as to determine a depth that the vibration source signal reaches, calculate a thickness of the filler, and determine the bearing compression rate of the filler in the gob area according to the thickness change of the filler.

A method for monitoring bearing compression rate of a filler in a coal mine gob area, specifically including the following steps:

(1) finding out a thickness and a mining height of a mined coal seam and a buried depth of the coal seam before a test is performed;

(2) determining a position on the ground corresponding to the filler in the gob area according to a filler to be tested; during the arrangement of the wave detectors in the trend, arranging one wave detector every 20 m, such that an angle $\alpha$ between reflected wave and the horizontal plane is in the range 30°-90°; simultaneously, correspondingly arranging the ground information processing system, the ground vibration source control system and the ground monitoring system on the ground;

(3) after a 2 Mpa pressure is applied to compact the fillers in the gob area, impacting the ground by the ground vibration source control system to generate vibration and transmit a signal, such that an elastic wave is transmitted in the fillers with different compaction degrees; receiving by the ground monitoring system (3) the reflected waves from the fillers with different compaction degrees, converting by the wave detectors the received reflected wave signals into electrical signals, transmitting the electrical signals to the information processing system for analyzing, and finally testing a height $h_1$ of the filler after being compacted for the first time;

(4) continuing to monitoring the thickness of the filler, until the thickness of the filler does not change, that is, the filler is stabilized; and (5) recording the thickness of the filler in the gob area after being initially filled as $h_1$, and the thickness of the stabilized filler as $h_2$, and calculating the bearing compression rate of the filler according to a bearing compression rate calculation formula $(h_1-h_2)/h_1$.

Beneficial effects: the present invention provides a system and method for monitoring bearing compression rate of a filler in a coal mine gob area; compared with the prior art, the present invention has the following advantages: the method combines a green solid filling and coal mining method with a geophysical exploration technology, not only can retain environmentally friendly development under the premise of green mining, but also can monitoring the thickness change of the filler during solid filling and mining, thus improving the solid filling efficiency, and realizing green mining. The method of the present invention is novel, integrates the geophysical exploration technology and the solid filling and coal mining technology, and has a great generalization value.

BRIEF DESCRIPTION OF THE DRAWINGS

FIG. 1 is a systematic layout diagram of the system and method for monitoring bearing compression rate of a filler in a coal mine gob area according to the present invention.

In the FIGURES: 1, ground information processing system; 2, ground vibration source control system; 3, ground information monitoring system (wave detector); 4, reflected wave; 5, filler

DETAILED DESCRIPTION OF THE EMBODIMENTS

The present invention discloses a system and method for monitoring bearing compression rate of a filler in a coal mine gob area, utilizes a geophysical exploration principle, applies an exploration technology to a coal mine filling and coal mining technology, monitors in real time the bearing compression rate of a filler in a gob area, and improves the filling effect during coal mine filling and mining. The system mainly includes a ground information processing system, a ground vibration source control system, and a ground monitoring system. The information processing system, the vibration source control system, and the monitoring system are arranged on the ground according to a buried depth of the filler in the gob area, wherein the vibration source control system generates a certain intensity of vibration, and transmits a signal to the filler; the monitoring system on the ground would receive different reflected waves according to different elasticities of the fillers under different compaction degrees; and finally data is transmitted to the information processing system for data processing; the monitoring of the filler starts when the filler is filled in the gob area; as time goes, the filler is gradually compacted; the filler is monitored until the thickness of the filler does not change, that is the filler is stabilized; and finally, a bearing compression rate formula is utilized to calculate the bearing compression rate of the filler. The present invention provides a system and method for monitoring bearing compression rate of a filler in a coal mine gob area, and monitors the thickness change of the filler, while also effectively improving filling efficiency and effect during filling.

The present invention will be further described hereafter in combination with the drawings and embodiments.

FIG. 1 shows the system and method for monitoring bearing compression rate of a filler in a coal mine gob area. The method includes: utilizing a geophysical exploration principle to transmit a vibration source signal to the filler in the underground gob area; determining a depth that the vibration source signal reaches according to a principle that the ground receives different reflected wave signals when the elasticities of the fillers under different compaction degrees are different; determining the thickness of the filler; and determining the bearing compression rate of the filler in the gob area according to the thickness change of the filler.

The monitoring system includes a ground information processing system 1, a ground vibration source control system 2, and a ground information monitoring system 3.

The ground information processing system 1 is used to receive an electrical signal from the ground monitoring system 3, and processes the electrical signal, wherein the electrical signal is converted from a reflected wave signal of the filler 5 by a wave detector of the ground monitoring system 3; the ground information processing system is further used to determine a depth that a signal transmitted by a controllable vibration source reaches according to wave energy consumption, and utilize a bearing compression rate formula to calculate the bearing compression rate of the filler 5 according to a difference between a thickness of the compacted filler 5 under a 2 MPa initial pressure and a thickness of the stabilized filler 5.

The ground vibration source control system 2 is used to adjust a vibration amplitude of the vibration source on the ground according to a depth of a filler to be tested 5, and transmit a stereo signal in a direction from the center of an upper surface of the controllable vibration source to the filler 5 in the gob area. When the ground vibration source control system 2 transmits a vibration wave to the filler, with the increase of the buried depth of the coal seam, the angle between the reflected wave transmitted by the filler and the horizontal plane gradually increases. In the effective depth range of the entire coal seam, an angle $\alpha$ between the reflected wave and the horizontal plane is in the range 30°-90°. When the effective shallowest buried depth of the coal seam is 100 m, the minimum angle $\alpha$ of the reflected wave is 30°; and when the reflected wave returns along the original route, the angle $\alpha$ of the reflected wave 90° at the most.

The ground vibration source system transmits a vibration wave to the filler; the vibration wave is reflected back by the filler, and is received by the wave detector.

The ground information monitoring system 3 is a wave detector, and is used to receive reflected waves having different depths and different angles under the wave detector and transmitted by the fillers 5 with different compaction degrees, wherein the source of the reflected wave 4 is determined according to the different densities of the rock formation and the filler 5. The effective depth of the coal seam that the wave detector can monitor is 100-300 m, and the maximum effective thickness is 3.5 m. With the increase of the buried depth of the coal seam which can be monitored, the signal of the reflected wave 4 gradually attenuates, and the precision of monitored data is reduced accordingly. The method for monitoring bearing compression rate of a filler in a coal mine gob area in the present invention includes the following steps:

(1) finding out a thickness and a mining height of a mined coal seam and a buried depth of the coal seam before a test is performed;

(2) determining a position on the ground corresponding to the filler 5 in the gob area according to a filler to be tested 5; during the arrangement of the wave detectors in the trend, arranging one wave detector every 20 m, such that an angle $\alpha$ between reflected wave and the horizontal plane is in the range 30°-90°; simultaneously, correspondingly arranging the ground information processing system 1, the ground vibration source control system 2 and the ground monitoring system 3 on the ground;

(3) after a 2 Mpa pressure is applied to compact the fillers in the gob area, impacting the ground by the ground vibration source control system 2 to generate vibration and transmit a signal, such that an elastic wave is transmitted in the fillers with different compaction degrees; receiving by the ground monitoring system 3 the reflected waves from the fillers with different compaction degrees, converting by the wave detectors the received reflected wave signals into electrical signals, transmitting the electrical signals to the information processing system 1 for analyzing, and finally testing a height $h_1$ of the filler after being compacted for the first time;

(4) continuing to monitoring the thickness of the filler, until the thickness of the filler does not change, that is, the filler is stabilized; and (5) recording the thickness of the filler in the gob area after being initially filled as $h_1$, and the thickness of the stabilized filler as $h_2$, and calculating the bearing compression rate of the filler according to a bearing compression rate calculation formula $(h_1-h_2)/h_1$.

The method for monitoring bearing compression rate of a filler in a coal mine gob area is characterized in that the ground information processing system 1, the ground vibration source control system 2, and the ground monitoring system 3 are combined to monitoring the bearing compression rate of the filler after the gob area is filled.

Embodiment

In a certain mining area, railways and buildings are dense; a transportation mine area railway is located 200 m far away from the position above the main minable coal seam, and a mechanical repair workshop is located above the main coal seam. Therefore, a great deal of coal is buried under surface water-body, building or railway, and mining the coal under surface water-body, building or railway becomes an inevitable selection. The working face 121101 of the mine is located below the transportation railway, and adopts a solid filling coal mining method. The buried depth of the coal seam of the working face is 270 m, the thickness of the minable coal seam is 3.05 m, and the inclination angle of the coal seam is 10°; during filling and mining the working face 121101, the geophysical exploration principle is utilized to arrange a vibration source control system, an information monitoring system and an information processing system above the filler; wave detectors are arranged along the trend of the coal seam; 25 wave detectors are arranged on each side, and one wave detector is arranged every 20 m. Totally 50 wave detectors are arranged, Wherein in the entire filling and mining process of the working face 121101, monitoring starts from the beginning of the filling until the thickness of the filler does not change, that is, the thickness of the filler tends to be stable under the action of an overlying stratum. The monitored data is as shown in the following table:

TABLE 1

Monitored data of the thickness change of the filler

| | Monitoring times | | | | |
|---|---|---|---|---|---|
| Coal seam thickness | First time | Second time | Third time | Fourth time | Fifth time |
| Initial filling height/m | 2.98 | 2.98 | 2.98 | 2.98 | 2.98 |
| Thickness corresponding to measurement times/m | 2.97 | 2.82 | 2.79 | 2.78 | 2.78 |
| Compression rate | 0.0034 | 0.054 | 0.064 | 0.067 | 0.067 |

In the entire filling and mining process of the working face 121101, the change of the filler in the gob area is monitored in real time; when the coal seam is finally filled and mined completely and the filler tends to be stable, the bearing compression rate k of the filler is monitored to be 0.067; and after the working face is filled and mined, the transportation mine area railway can still normally used. Therefore, the method for monitoring bearing compression rate of a filler in a coal mine gob area not only can monitors the thickness change of the filler, but also can effectively improve the filling efficiency and effect during filling.

The descriptions above are only a preferred embodiment of the present invention. It should be noted that a person skilled in the art can make a plurality of improvements and modifications without departing from the principle of the present invention. These improvements and modifications should also be regarded as the protection scope of the present invention.

What is claimed is:

1. A method for monitoring bearing compression rates of fillers in a gob area of mining a coal seam, comprising:

providing a ground information processing system, a ground vibration source control system, and a ground monitoring system which are all disposed on a ground above fillers to be tested in the gob area, wherein the ground monitoring system comprises wave detectors;

after filling the gob area with the fillers and compacting the fillers in the gob area using a 2 Mpa pressure, monitoring a thickness of the fillers, wherein the monitoring the thickness of the fillers comprises:

impacting the ground by the ground vibration source control system to generate a vibration, such that an elastic wave of the vibration is transmitted to the fillers;

receiving reflected waves of the elastic wave from the fillers by the ground monitoring system, and converting the received reflected waves into electrical signals by the wave detectors of the ground monitoring system; and transmitting the electrical signals to the information processing system for analyzing and obtaining the thickness of the fillers;

continuing the monitoring to obtain different thicknesses of the fillers, until the thickness of the fillers do not change as stabilized fillers; and recording the thickness of the fillers in the gob area after being initially filled and compacted as $h_1$, recording the thickness of the stabilized fillers as $h_2$, and calculating bearing compression rates of the fillers by the ground information processing system according to a bearing compression rate calculation formula ($h_1-h_2/h_1$, wherein the ground vibration source control system adjusts a vibration amplitude of a vibration source to generate the vibration according to a depth of the fillers; and the thickness of the fillers is obtained based on a depth that the elastic wave of the vibration transmitted from the vibration source reaches and the depth is determined according to a wave energy consumption, wherein the depth gradually increases the reflected waves gradually attenuate.

2. The method for monitoring bearing compression rates of fillers in a gob area of mining a coal seam according to claim 1, wherein an effective depth of a coal seam that the wave detectors monitor is 100-300 m, and a maximum effective thickness of a coal seam that the wave detectors monitor is 3.5 m.

3. The method for monitoring bearing compression rates of fillers in a gob area of mining a coal seam according to claim 1, wherein in an effective depth range of the coal seam, an angle $\alpha$ between the reflected waves and a horizontal plane is in a range 30°-90°.

4. The method for monitoring bearing compression rates of fillers in a gob area of mining a coal seam according to claim 1, wherein the wave detectors are arranged at positions on the ground corresponding to the fillers; the wave detectors are arranged in a trend of the coal seam to form a ground monitoring point arrangement route which centers on the vibration source control system above a working face and extends to two sides of the ground vibration source control system in the trend; the wave detectors are linearly uniformly distributed; and one wave detector is arranged every 20 m on the two sides.

5. The method for monitoring bearing compression rates of fillers in a gob area of mining a coal seam according to claim 1, wherein the ground monitoring system receives different reflected wave according to different elasticities of the fillers under different compaction degrees.

* * * * *